US011297699B2

(12) United States Patent
Peng

(10) Patent No.: US 11,297,699 B2
(45) Date of Patent: Apr. 5, 2022

(54) LED MODULE WITH SLEEP MODE AND LED LIGHT STRING HAVING THE SAME

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 13 days.

(21) Appl. No.: 16/935,604

(22) Filed: Jul. 22, 2020

(65) Prior Publication Data

US 2022/0030680 A1 Jan. 27, 2022

(51) Int. Cl.

| | |
|---|---|
| ***H05B 45/14*** | (2020.01) |
| ***H05B 47/14*** | (2020.01) |
| ***H05B 47/155*** | (2020.01) |

(52) U.S. Cl.

CPC ..... *H05B 45/14* (2020.01); *H05B 47/14* (2020.01); *H05B 47/155* (2020.01)

(58) Field of Classification Search

None

See application file for complete search history.

(56) References Cited

U.S. PATENT DOCUMENTS

2017/0347417 A1* 11/2017 Chen ..... H05B 45/3725

* cited by examiner

*Primary Examiner* — Dedei K Hammond

(74) *Attorney, Agent, or Firm* — Muncy, Geissler, Olds & Lowe, P.C.

(57) ABSTRACT

An LED module with sleep mode includes a detection circuit, a driver circuit, and at least one LED. A control unit of the driver circuit receives and stores a lighting command according to a lighting drive signal, and controls lighting behaviors of the at least one LED according to the lighting command. When the driver circuit detects that the voltage of the lighting drive signal decreases below a first threshold value, the driver circuit performs signal identifications of the lighting drive signal. When the driver circuit detects that the voltage of the lighting drive signal decreases below a second threshold value through a second detection signal provided by the detection circuit, the driver circuit enters a sleep mode from a working mode, and minimizes the discharge speed of the lighting drive signal.

13 Claims, 9 Drawing Sheets

LED MODULE WITH SLEEP MODE AND LED LIGHT STRING HAVING THE SAME

BACKGROUND

Technical Field

The present disclosure relates to an LED module and an LED light string having the same, and more particular to an LED module with sleep mode and an LED light string having the same.

Description of Related Art

The statements in this section merely provide background information related to the present disclosure and do not necessarily constitute prior art.

Since light-emitting diode (LED) has the advantages of high luminous efficiency, low power consumption, long life span, fast response, high reliability, etc., LEDs have been widely used in lighting fixtures or decorative lighting, such as Christmas tree lighting, lighting effects of sport shoes, etc. by connecting light bars or light strings in series, parallel, or series-parallel.

Take the festive light for example. Basically, a complete LED light string includes a plurality of LED modules (having a plurality of LEDs inside) and a control module for driving the LED modules. The control module and the LED modules are electrically connected, and controls the LEDs by a pixel control manner or a synchronous manner by providing the required power and the lighting drive signal having lighting commands to the LEDs, thereby implementing various lighting output effects and changes of the LED lamp.

With the progress of the technology, the carrier manner can be utilized for the lighting drive signal having the lighting commands to transmit the lighting drive signal through the power wire. The functions of providing power and data transmission can be achieved by the same circuit structure to simplify the layout design, reduce the volume of the circuit, and benefit the design of the control circuit. However, since the analog circuit in the LED module consumes a large amount of power when it is in operation, it is impossible to reduce the overall power consumption of the LED light string, and this carrier technology requires the second voltage as the signal voltage.

Therefore, how to design an LED module with sleep mode and an LED light string having the same, which uses the most streamlined circuit that saves external signal voltage and reduces power consumption to achieve a carrier on the power wire and transmit signals, and when the LED module does not need to work, it is turned off to save the overall power consumption of the LED module and the LED light string, is a major topic for the inventor of this present disclosure.

SUMMARY

In order to solve the above-mentioned problems, an LED module with sleep mode is provided. The LED module with sleep mode includes a detection circuit, a driver circuit, and at least one LED. The detection circuit receives a lighting drive signal through a power wire. The driver circuit is coupled to the detection circuit and receives the lighting drive signal. The driver circuit includes a control unit. The control unit is coupled to the detection circuit. The at least one LED is coupled to the control unit. The control unit receives and stores a lighting command according to the lighting drive signal and controls lighting behaviors of the at least one LED according to the lighting command. When the driver circuit detects that the voltage of the lighting drive signal decreases below a first threshold value, the driver circuit performs signal identifications of the lighting drive signal, and when the signal identifications of the lighting drive signal are completed, the driver circuit changes from a working mode to a sleep mode. When the voltage of the lighting drive signal decreases below a second threshold value, the driver circuit slows down the discharge speed of the lighting drive signal.

In one embodiment, when the driver circuit detects that the lighting drive signal rises to be greater than or equal to the second threshold value according to the second detection signal, the driver circuit changes from the sleep mode back to the working mode.

In one embodiment, the detection circuit includes a voltage division circuit, a first comparator, and a second comparator. The voltage division circuit receives the lighting drive signal. The first comparator is coupled to the voltage division circuit and receives a first reference voltage. The second comparator is coupled to the voltage division circuit and receives a second reference voltage. The first comparator provides the first detection signal according to the first reference voltage and a voltage division value corresponding to the lighting drive signal, and the second comparator provides the second detection signal according to the second reference voltage and the voltage division value corresponding to the lighting drive signal.

In one embodiment, the detection circuit includes a first resistor, a first switch, and a voltage division circuit. The first resistor has a first end and a second end. The first end receives the lighting drive signal and the second end receives a first reference voltage. The first switch has an input end, an output end, and a control end. The input end receives the lighting drive signal and the control end is coupled to the second end of the first resistor. The voltage division circuit is coupled to the output end of the first switch and the control unit. The voltage division circuit divides a voltage at the output end of the first switch and provides the first detection signal and the second detection signal.

In one embodiment, the driver circuit further includes an oscillator. The oscillator is coupled to the control unit and receives the lighting drive signal. In the working mode, the oscillator provides a clock signal to the control unit according to the lighting drive signal. In the sleep mode, a sleep signal provided by the control unit turns off the oscillator and an analog circuit so that the oscillator does not provide the clock signal to the control unit and the analog circuit is turned off.

In one embodiment, the oscillator includes a first inverter and a second inverter. The first inverter has an input end, an output end, and a power end. The input end is coupled to a first end of a second resistor and a first end of a first capacitor, the output end is coupled to a second end of the second resistor, and the power end receives the lighting drive signal and the sleep signal. The second inverter has an input end, an output end, and a power end. The input end is coupled to the first inverter and the second end of the second resistor, the output end is coupled to a second end of the first capacitor and the control unit, and the power end receives the lighting drive signal and the sleep signal.

In one embodiment, the driver circuit includes a latch circuit. The latch circuit receives the lighting drive signal and the first detection signal. When the latch circuit realizes that a time that the lighting drive signal is less than the first threshold value is greater than or equal to a holding time according to the first detection signal, a latch signal provided by the latch circuit makes the control unit store the identified lighting drive signal as the lighting command.

In one embodiment, the control unit includes a logic circuit and a register. The logic circuit coupled to the detection circuit. The register is coupled to the logic circuit. The latch circuit is composed of logic gates and integrated in the logic circuit. When a time that the lighting drive signal is less than the first threshold value is greater than or equal to the holding time, the latch signal provided by the logic gate makes the logic circuit notify the register to store the identified lighting drive signal as the lighting command.

In one embodiment, the latch circuit includes a second switch and a third switch. The second switch has an input end, an output end, and a control end. The output end is coupled to the power wire and a first end of a second capacitor, the input end is coupled to a second end of the second capacitor, a first end of a third resistor, and the control unit, and the control end receives the first detection signal. The third switch has an input end, an output end, and a control end. The input end is coupled to a second end of a second resistor, the output end is coupled to a ground point, and the control end receives the first detection signal.

In one embodiment, the latch circuit includes a second switch and a third switch. The second switch has an input end, an output end, and a control end. The output end is coupled to the power wire, the input end is coupled to a first end of a third resistor, and the control end receives the first detection signal. The third switch has an input end, an output end, and a control end. The input end is coupled to a second end of a second resistor, a first end of a second capacitor, and the control unit, the output end is coupled to a second end of the second capacitor and a ground point, and the control end receives the first detection signal.

In one embodiment, the driver circuit includes a discharge circuit. The discharge circuit is coupled to the power wire and receives the second detection signal. When the discharge circuit realizes that the lighting drive signal is less than the second threshold value through the second detection signal, the discharge circuit slows down the discharge speed of the lighting drive signal.

In one embodiment, the discharge circuit includes a discharge switch. The discharge switch has an input end, an output end, and a control end. The input end is coupled to the power wire, the output end is coupled to a ground point, and the control end receives the second detection signal.

In order to solve the above-mentioned problems, an LED light string with sleep mode is provided. The LED light string with sleep mode includes a power wire, a control module, and at least one LED module. The power wire receives a DC working voltage. The control module is coupled to the power wire. The control module includes a power switch and a controller. The power switch is coupled to the power wire. The controller is coupled to the power switch. Each of the at least one LED module is an LED module with sleep mode. The at least one LED module is coupled to the control module through the power wire, and receives the lighting drive signal and the DC working voltage transmitted by the control module through the power wire. When the controller controls turning on the power switch, the DC working voltage provides a power-supplying path for supplying power to the at least one LED module through the power wire. When the controller wants to generate the lighting drive signal belonging to one LED module of the at least one LED module, the controller continuously switches turning on and turning off the power switch according to the lighting command so that the DC working voltage on the power wire provides the lighting drive signal composed of a plurality of pulses, and the lighting drive signal is transmitted to the LED module through the power wire.

The main purpose and effect of the present disclosure is that when the driver circuit operates in the sleep mode, the driver circuit and the analog circuit do not work (that is, the oscillator is turned off and the main power-consuming components of the driver circuit are turned off), thereby saving the power consumption of the LED modules.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The present disclosure can be more fully understood by reading the following detailed description of the embodiment, with reference made to the accompanying drawing as follows.

DETAILED DESCRIPTION

Figure 1A:
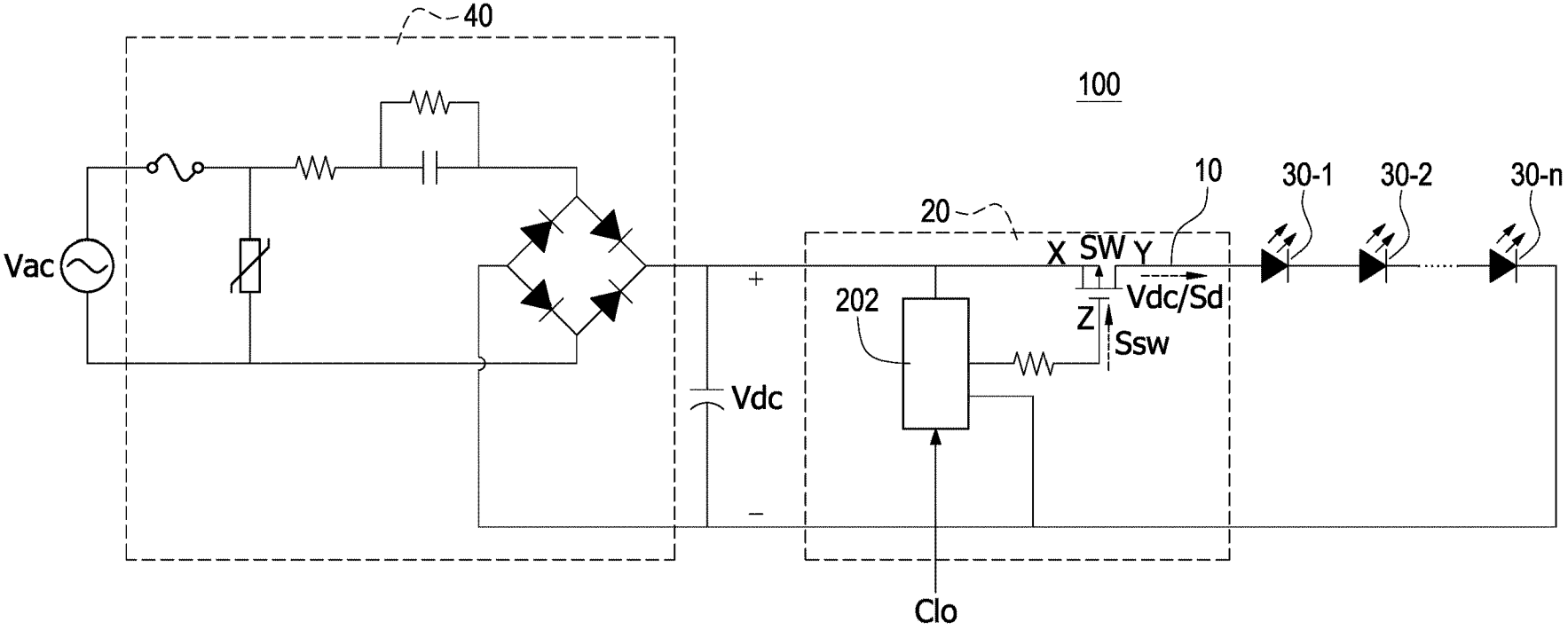
FIG. 1A is a block circuit diagram of an LED light string with sleep mode according to a first embodiment of the present disclosure.

Reference will now be made to the drawing figures to describe the present disclosure in detail. It will be understood that the drawing figures and exemplified embodiments of present disclosure are not limited to the details thereof.

Please refer to FIG. 1A, which shows a block circuit diagram of an LED light string with sleep mode according to a first embodiment of the present disclosure. The LED light string 100 includes a power wire 10, a control module 20, at least one LED (light-emitting diode) module 30-1 to **30-*n*, and a rectifier 40. The rectifier 40 is coupled to the power wire 10, and receives an input power source Vac and rectifiers the input power source Vac into a DC working voltage Vdc. The control module 20 receives the DC working voltage Vdc and controls lighting behaviors of the at least one LED module 30-1 to 30-*n*. In particular, the lighting behaviors are, for example but not limited to, color changes, light on/off manner, light on/off frequency, etc. The control module 20 is coupled to the power wire 10 and is coupled to the at least one LED module 30-1 to 30-*n* through the power wire 10. The LED modules 30-1 to 30-*n* can be coupled in series or coupled in parallel. In this embodiment, the LED modules 30-1 to 30-*n* are coupled in series. The LED modules 30-1 to 30-*n* receive a lighting drive signal Sd and the DC working voltage Vdc transmitted from the control module 20**. In particular, the DC working voltage Vdc can be acquired by a DC converter (not shown) installed in the front stage, or the DC working voltage Vdc can be acquired by a (rechargeable) battery.

Specifically, the control module 20 includes a power switch SW and a controller 202. An input end X and an output end Y of the power switch SW are coupled to the power wire 10, and a control end Z of the power switch SW is coupled to the controller 202. The controller 202 receives the DC working voltage Vdc through the power wire 10 and provides a switch signal Ssw to control turning on and turning off the power switch SW. When the controller 202 controls turning on the power switch SW, the DC working voltage Vdc provides a power-supplying path for supplying power to the LED modules 30-1 to **30-*n* through the power wire 10. When the controller 202 wants to generate the lighting drive signal Sd belonging to a certain LED module 30-1 to 30-*n* (it is assumed to belong the first LED module 30-1), the controller 202 continuously switches turning on and turning off the power switch SW according to a lighting command of the first LED module 30-1 so that the DC working voltage Vdc on the power wire 10 provides a lighting drive signal Sd composed of a plurality of pulses belonging to the LED module 30-1, and the lighting drive signal Sd is transmitted to the LED module 30-1 through the power wire 10**.

The controller 202 can receive external lighting command Clo through a wired manner or a wireless manner as well as internal lighting command stored inside the controller 202 so that the controller 202 can control turning on or turning off the power switch SW to generate the lighting drive signal Sd according to the internal lighting command or the external lighting command Clo so as to control the LED modules 30-1 to **30-*n* through the lighting drive signal Sd. For example, the user may operate a computer through the wired manner to transmit the external lighting command Clo to the controller 202 so that the controller 202 performs lighting control according to the external lighting command Clo. Alternatively, the user may operate a mobile phone or a wearable device through the wireless manner to transmit the external lighting command Clo to the controller 202 so that the controller 202** performs lighting control according to the external lighting command Clo. However, the present disclosure is not limited by the above-mentioned manners of transmitting the external lighting command Clo and the devices operated by the user.

Take the controller 202 transmits the lighting drive signal Sd for the LED module 30-1 according to the lighting command for the LED module 30-1 as an example. The controller 202 can generate a notification signal for command transmission by controlling switching of the power switch SW. When the LED modules 30-1 to **30-*n* receive the notification signal, and then to perform command reception. Afterward, the controller 202 converts the lighting command belonging to the LED module 30-1 into the lighting drive signal Sd by controlling turning on and turning off the power switch SW. The pulse of the lighting drive signal Sd can be composed of address data in the form of "0" and "1" plus the brightness "11" and the color "10" of the LED light. The lighting drive signal Sd includes, for example but not limited to, 10 pulses, and the address data corresponding to the address of the first LED module 30-1. When the LED modules 30-1 to 30-*n* receive the address data, the LED module 30-1 realizes that the successively transmitted lighting drive signal Sd belongs to its own lighting drive signal Sd so as to identify the lighting drive signal Sd. After the signal identifications of the nine pulses are completed, the controller 202 generates the notification signal (that is, the last pulse) of representing the command transmission completion by controlling switching of the power switch SW. Accordingly, the LED module 30-1 generates a latch signal according to the notification signal and stores the lighting commands corresponding to the nine pulses, and generates the lighting behaviors according to the stored lighting commands. In particular, the LED module 30-1 has various control manners, but its spirit is roughly the same as the above-mentioned control manner, and the control manner the LED modules 30-2 to 30-*n* is also the same as the LED module 30-1**, and will not be repeated here.

Figure 1B:
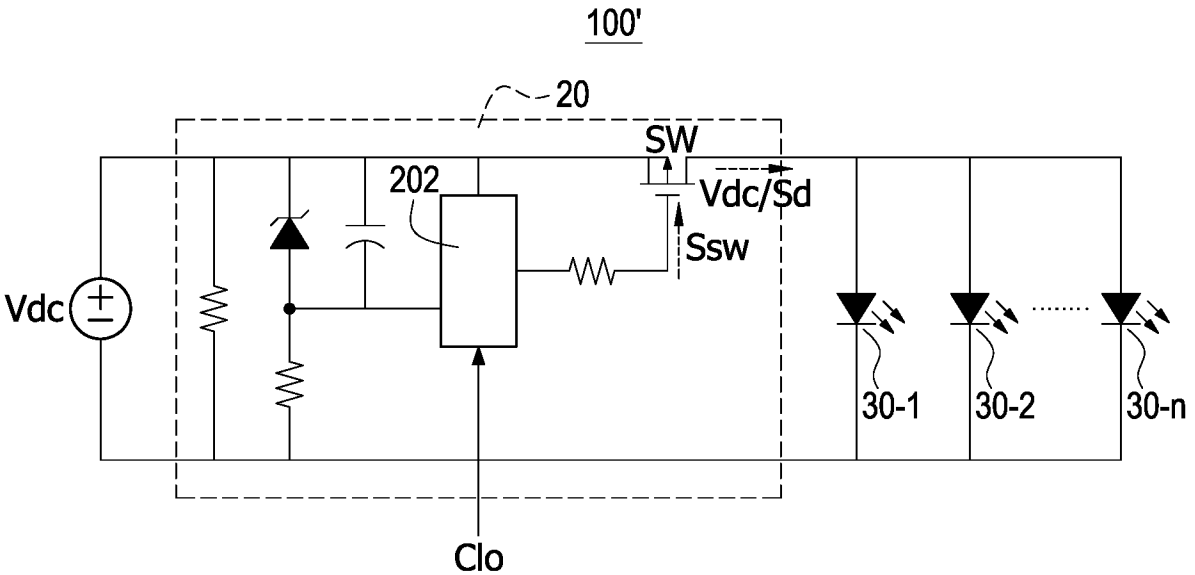
FIG. 1B is a block circuit diagram of the LED light string with sleep mode according to a second embodiment of the present disclosure.

Please refer to FIG. 1B, which shows a block circuit diagram of the LED light string with sleep mode according to a second embodiment of the present disclosure, and also refer to FIG. 1A. The difference between the LED light string 100' shown in FIG. 1B and the LED light string 100 shown in FIG. 1A is the absence of the rectifier 40 and the parallel-connected LED modules 30-1 to **30-*n* in the former. The control module 20 of the LED light string 100 receives the DC working voltage Vdc externally provided and controls the lighting behaviors of the at least one LED module 30-1 to 30-*n*. In particular, the components, the coupling relationships, and the control manners which are not mentioned in the LED light string 100' are the same as those in FIG. 1**A, and will not be repeated here.

Figure 1C:
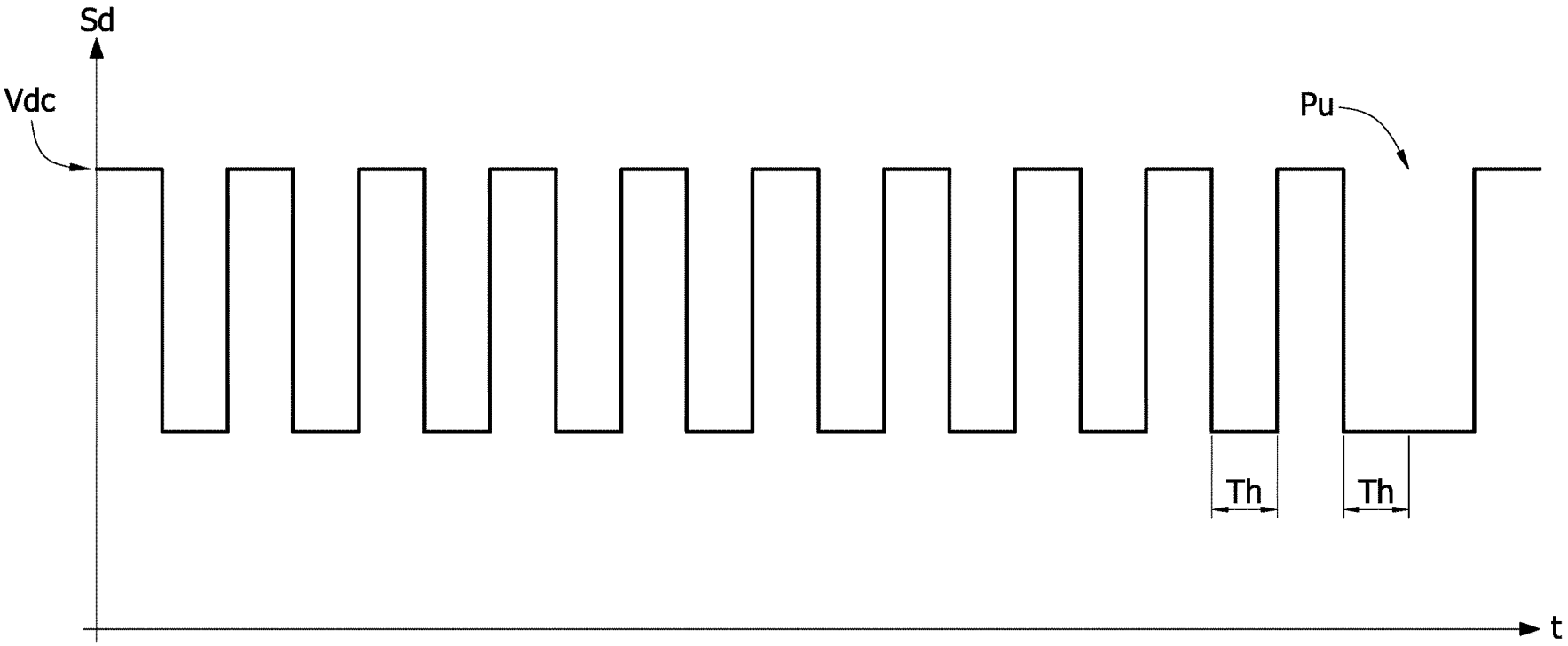
FIG. 1C is a schematic waveform of a lighting drive signal according to the present disclosure.

Please refer to FIG. 1C, which shows a schematic waveform of a lighting drive signal according to the present disclosure, and also refer to FIG. 1A and FIG. 1B. The lighting drive signal Sd in this embodiment is illustrated by a 10-cycle pulse. When the controller 202 controls turning on the power switch SW, the DC working voltage Vdc provides a power-supplying path for supplying power to the LED modules 30-1 to **30-*n* through the power wire 10. When the controller 202 wants to generate the lighting drive signal Sd, the controller 202 continuously switches turning on and turning off the power switch SW according to the lighting command so that the DC working voltage Vdc on the power wire 10 is switched to form the lighting drive signal Sd composed of 10-cycle pulse Pu, and the lighting drive signal Sd is transmitted to the LED module 30-1 through the power wire 10. In this embodiment, the last pulse Pu has a longer time at low level. When the LED module 30-1 detects that the pulse Pu has a longer time at low level, the pulse Pu is the notification signal of the completion of the command transmission. That is, the time at low level of the last pulse Pu exceeds the time (holding time Th) at low level of each of the first nine pulses. At this condition, the LED modules 30-1 to 30-*n*** generate a latch signal to store the lighting commands corresponding to the nine pulses Pu according to the notification signal and generate lighting behaviors according to the stored lighting commands.

Figure 2A:
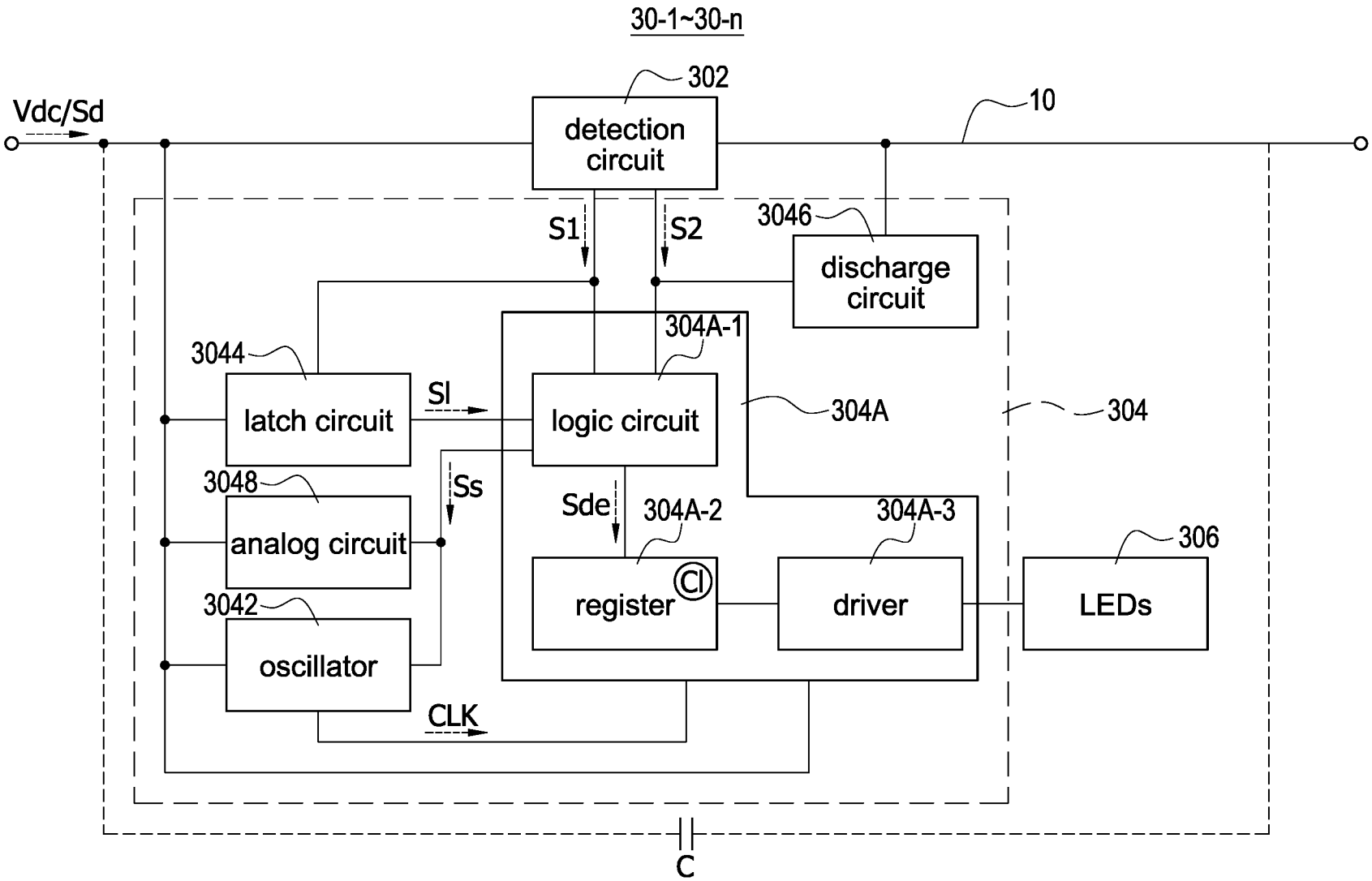
FIG. 2A is a block circuit diagram of an LED module with sleep mode according to the present disclosure.
Figure 2B:
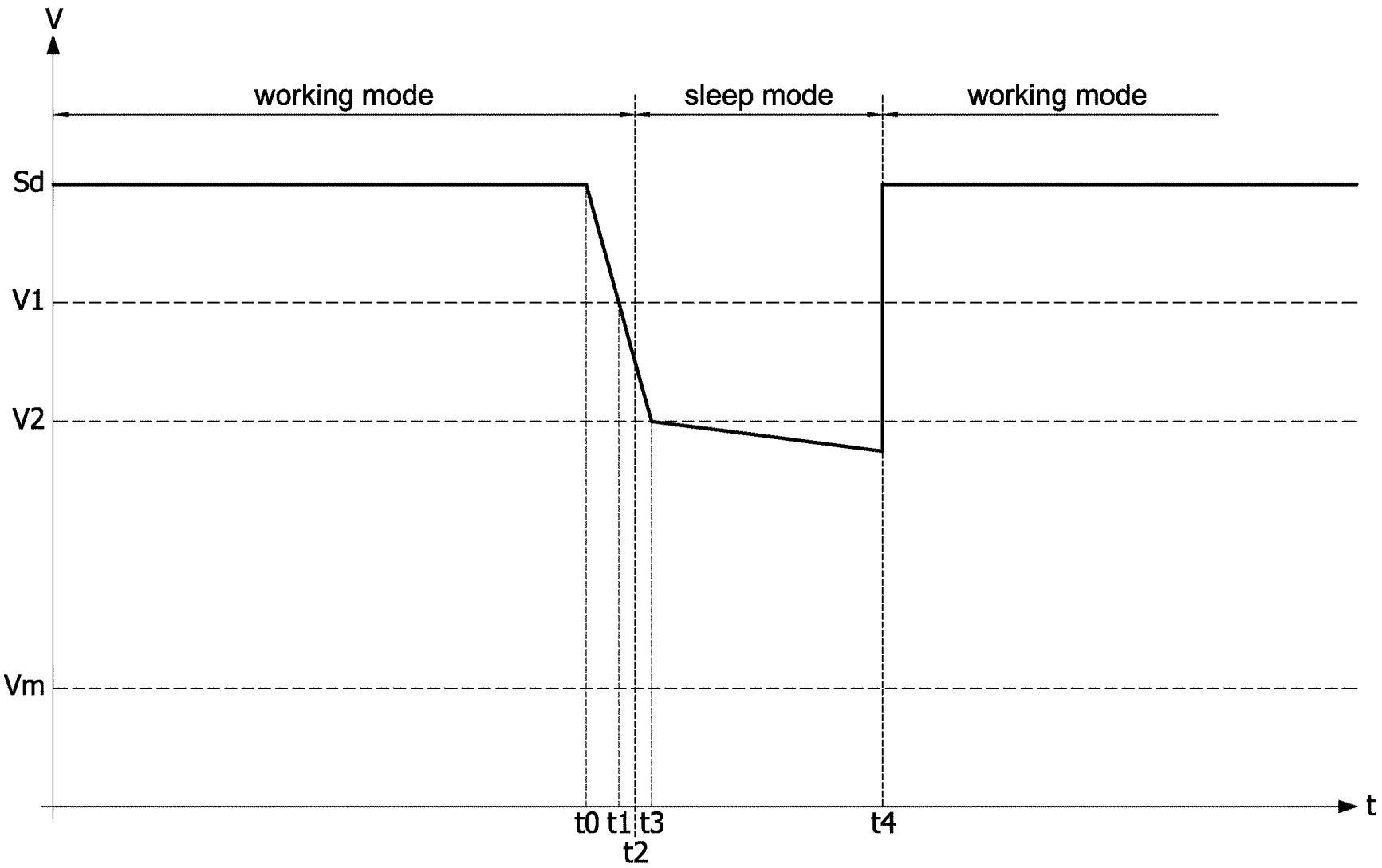
FIG. 2B is a schematic waveform of the lighting drive signal according to the present disclosure.

Please refer to FIG. 2A, which shows a block circuit diagram of an LED module with sleep mode according to the present disclosure; please refer to FIG. 2B, which shows a schematic waveform of the lighting drive signal according to the present disclosure, and also refer to FIG. 1A and FIG. 1B. Each of the LED modules 30-1 to **30-*n* includes a detection circuit 302, a driver circuit 304, and at least one LED 306. In this embodiment, three LEDs 306 are exemplified for further demonstration. The driver circuit 304 is coupled to the detection circuit 302 and the LEDs 306. The detection circuit 302 receives the DC working voltage Vdc or the lighting drive signal Sd through the power wire 10, and provides a first detection signal S1 and a second detection signal S2 to the driver circuit 304 according to the lighting drive signal Sd. The driver circuit 304 receives the DC working voltage Vdc or the lighting drive signal Sd through the power wire 10. When the driver circuit 304 receives the DC working voltage Vdc, the driver circuit 304 operates in a working mode. At this condition, a control unit 304A inside the driver circuit 304 controls lighting behaviors of the LEDs 306 according to a lighting command Cl, and the lighting command Cl is acquired according to the lighting drive signal Sd provided by the controller 202. In one embodiment, the detection circuits 302 and the driver circuits 304 of the LED modules 30-1 to 30-*n* may be packaged together, but not limited to this. In other words, the LED modules 30-1 to 30-*n* can be packaged together according to actual needs, or the components inside the LED modules 30-1 to 30-*n*** can be set independently.

When the driver circuit 304 receives the lighting drive signal Sd, the driver circuit 304 adjusts its operation modes according to the first detection signal S1 and the second detection signal S2. Specifically, as shown in FIG. 2B, the power switch SW is turned off at the time point t0 so that a voltage of the lighting drive signal Sd starts to decrease. When the driver circuit 304 detects that the voltage of the lighting drive signal Sd decreases below the first threshold value V1 (at the time point t1) through the first detection signal S1, the driver circuit 304 performs the signal identifications of the lighting drive signal Sd. At this condition, the driver circuit 304 still operates in the working mode and the signal identifications of the lighting drive signal Sd are completed at the time point t2. After the signal identifications of the lighting drive signal Sd are completed (after the time point t2), the driver circuit 304 changes from the working mode to the sleep mode. When the driver circuit 304 detects that the voltage of the lighting drive signal Sd decreases below the second threshold value V2 (at the time point t3) through the second detection signal S2, the driver circuit 304 slows down the discharge speed of the lighting drive signal Sd (that is, the slope of the voltage fall changes). Finally, at the time point t4, the voltage of the pulse rises from less than the second threshold value V2 to greater than the first threshold value V1 so that the driver circuit 304 changes from the sleep mode to the working mode. At this condition, the driver circuit 304 is woken up and enters the working mode. Therefore, it can be known that the driver circuit 304 operates in the sleep mode when the lighting drive signal Sd is completely identified and the pulse voltage rises from less than the second threshold value V2 to greater than the first threshold value V1. Except, the driver circuit 304 is in the working mode.

Furthermore, as shown in FIG. 2A, the driver circuit 304 includes an oscillator 3042, a latch circuit 3044, a discharge circuit 3046, and a control unit 304A. The control unit 304A includes a logic circuit 304A-1, a register 304A-2, and a driver 304A-3. When the driver circuit 304 operates in the working mode, the above-mentioned components operate by receiving the DC working voltage Vdc or the lighting drive signal Sd. Since a clock signal CLK generated by the oscillator 3042 is closely related to the operation of the control unit 304A, and the oscillator 3042 is the main power-consuming component when the driver circuit 304 operates in the working mode, the main purpose and effect of the present disclosure is that when the driver circuit 304 operates in the sleep mode, the driver circuit 304 and the analog circuit do not work (that is, the oscillator 3042 is turned off and the main power-consuming components of the driver circuit 304 are turned off). Since the oscillator 3042 is turned off, the circuits in the control unit 304A (such as but not limited to the partial circuits of the driver 304A-3, the logic circuit 304A-1, and the register 304A-2) that are operated by the clock signal CLK are simultaneously turned off to save the power consumption of the LED modules 30-1 to **30-*n*. In particular, since the operation of the latch circuit 3044 does not use the clock signal CLK, when the oscillator 3042 is turned off, the latch circuit 3044 can still provide the latch signal S1 in the sleep mode according to the first detection signal S1. In addition, since the logic circuit 304A-1 is a digital passive component, even when the driver circuit 304 is in the sleep mode, as long as the voltage of the lighting drive signal Sd rises from less than the second threshold value V2 to greater than the first threshold value V1 to make the second detection signal S2 change, the passive logic circuit 304A-1 can still wake up all the components in the driver circuit 304** through the output of the signal.

Also refer to FIG. 2A, the control unit 304A receives the DC working voltage Vdc or the lighting drive signal Sd as a power source for operation. The logic circuit 304A-1 is coupled to the detection circuit 302. The logic circuit 304A-1 identifies the lighting drive signal Sd (signal identifications) according to the first detection signal S1 and provides the sleep signal Ss to the oscillator 3042 according to the second detection signal S2. The register 304A-2 is coupled to the logic circuit 304A-1. When the logic circuit 304A-1 receives the latch signal S1, the logic circuit 304A-1 provides the identified lighting drive signal Sde to the register 304A-2 so that the register 304A-2 stores the identified lighting drive signal Sde as the lighting command Cl. The driver 304A-3 is coupled to the register 304A-2 and the LEDs 306. The register 304A-2 controls the driver 304A-3 to drive the LEDs 306 according to the lighting command Cl so that the LEDs 306 generate lighting behaviors. In particular, the control unit 304A provides the plurality of pulses of the lighting drive signal Sd to the register 304A-2 at one time so that the register 304A-2 stores complete lighting command Cl at one time instead of adjusting the lighting behaviors of the LEDs 306 according to a single pulse without the received pulses at one time, thereby avoiding the situation that the lighting command Cl is easy to be wrong and the LEDs 306 produces the wrong lighting behaviors.

The oscillator 3042 receives the DC working voltage Vdc or the lighting drive signal Sd, and is coupled to the control unit 304A and the logic circuit 304A-1 of the control unit 304A. In the working mode, the oscillator 3042 provides the clock signal CLK to the control unit 304A according to the DC working voltage Vdc or the lighting drive signal Sd so that some components (not shown) that require the clock signal CLK in the control unit 304A operate according to the clock signal CLK. In the sleep mode, the logic circuit 304A-1 controls the oscillator 3042 to be turned off according to the sleep signal Ss so that the oscillator 3042 no longer provides the clock signal CLK to the control unit 304A. In the sleep mode, therefore, the oscillator 3042, which consumes a lot of power, and some components that operate by the clock signal CLK stop operating to save the power consumption of the LED modules 30-1 to **30-*n*. Form the sleep mode back to the working mode, the second detection signal S2 will change so that the logic circuit 304A-1 adjusts the sleep signal Ss according to the change of the second detection signal S2, and then the oscillator 3042 is woken up by the sleep signal Ss. In one embodiment, in the sleep, the sleep signal Ss provided by the control unit 304A according to the second detection signal S2 turns off the oscillator 3042 as well as turns off other analog circuits (not shown) in the driver circuit 304. Until the sleep mode returns to the working mode, the logic circuit 304A-1 activate other analog circuits (not shown). For example, but not limited to, the sleep signal Ss can control some signal detection circuits, protection circuits, etc. to sleep or work, thereby saving more power consumption of the LED modules 30-1 to 30-*n***.

The latch circuit 3044 receives the DC working voltage Vdc or the lighting drive signal Sd, and provides the latch signal S1 to the logic circuit 304A-1 according to the first detection signal S1. Specifically, the latch circuit 3044 controls the latch signal S1 by using the length of time. When the pulse width in the lighting drive signal Sd is too short, the latch signal S1 provided by the latch circuit 3044 causes the logic circuit 304A-1 not to provide the lighting command Cl to the register 304A-2. When the pulse width in the lighting drive signal Sd is too long, it represents that the time when the lighting drive signal Sd is less than the first threshold value V1 is greater than or equal to the holding time. At this condition, the latch signal S1 provided by the latch circuit 3044 makes the logic circuit 304A-1 notify the register 304A-2 to store the identified lighting drive signal Sde as the lighting command Cl to the register 304A-2 according to the latch signal S1.

The discharge circuit 3046 is coupled to the detection circuit 302 and the power wire 10. When the discharge circuit 3046 realizes that the lighting drive signal Sd is less than the second threshold value V2 according to the second detection signal S2, the discharge circuit 3046 slows down the discharge speed of the lighting drive signal Sd. Specifically, since some control units 304A do not have the function of power-off memory (i.e., the data stored in the control unit 304A is cleared (for example, but not limited to the lighting command Cl) when the voltage value of the DC working voltage Vdc or the voltage value of the lighting drive signal Sd is too low), the voltage value of the lighting drive signal Sd at the low level must be kept above the minimum working voltage Vm (as shown in FIG. 2B) to avoid the control unit 304A being reset due to the too-low voltage. The main function of the discharge circuit 3046 is to minimize the discharge speed of the lighting drive signal Sd as much as possible so as not to cause the voltage value of the lighting drive signal Sd to fall too fast, and therefore easier to sustain the time when the last pulse Pu is at the low level since the last pulse Pu is at the low level for a longer time. The discharge circuit 3046 slows down the discharge speed of the lighting drive signal Sd when the lighting drive signal Sd is less than the second threshold value V2, which can prevent the lighting drive signal Sd from being discharged too fast and causing the voltage value to be lower than the minimum working voltage Vm.

The LED module 30-1 to **30-*n* further includes an analog circuit 3048. The analog circuit 3048 is coupled to the control unit 304A, and receives the DC working voltage Vdc or the lighting drive signal Sd as a power source for operation. The LED light string is a light string having data burning function, and therefore each of the LED modules 30-1 to 30-*n* has own digital and analog circuits for burning light data and address data. For example, a light control unit (not shown) is responsible for light control, an address signal processing unit (not shown) is responsible for address signal processing, and the address burning unit (not shown) is responsible for address burning. In the sleep mode, the sleep signal Ss provided by the control unit 304A turns off the oscillator 3042 as well as turns off the analog circuit 3048, thereby saving power consumption of the LED modules 30-1 to 30-*n***.

The LED module 30-1 to **30-*n* further includes an energy storage capacitor C. The energy storage capacitor C is coupled between the input end and the output end of the LED modules 30-1 to 30-*n*. The energy storage capacitor C is used to stabilize the voltage across two ends (i.e., the input end and the output end) of the LED modules 30-1 to 30-*n* to reduce the instability of the control errors of the LED modules 30-1 to 30-*n* due to the voltage floating at two ends of the LED modules 30-1 to 30-*n* when the DC working voltage Vdc or the lighting drive signal Sd is transmitted from the input end of the LED modules 30-1 to 30-*n* to the output end thereof through the power wire 10. In one embodiment, the energy storage capacitor C is only used to stabilize the voltage across the LED modules 30-1 to 30-*n*, and it is not a necessary component of the LED modules 30-1 to 30-*n***, so it is indicated by a dotted line.

Figure 2C:
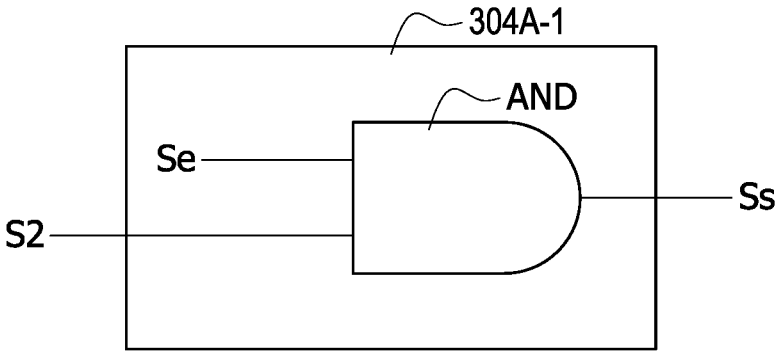
FIG. 2C is a circuit diagram of a logic circuit according to the present disclosure.

Please refer to FIG. 2C, which shows a circuit diagram of a logic circuit according to the present disclosure, and also refer to FIG. 1A to FIG. 2B. The logic circuit 304A-1 can, for example but not limited to, activate the sleep mode of the driver circuit 304 by a simple logic gate. As shown in FIG. 2C, one input end of an AND gate receives a completion signal Se that represents the signal identifications of the lighting drive signal Sd are completed. Whether the signal identifications are completed or not can be acquired by the logic circuit 304A-1 according to the input of the first detection signal S1. The other input end of the AND gate receives the second detection signal S2. When the completion signal Se and the second detection signal S2 are both 1, the AND gate outputs the sleep signal Ss with 1 to the oscillator 3042 so that the oscillator 3042 is turned off. When the completion signal Se and the second detection signal S2 are not both 1, the AND gate outputs the sleep signal Ss with 0 to the oscillator 3042 so that the oscillator 3042 is woken up.

Figure 3A:
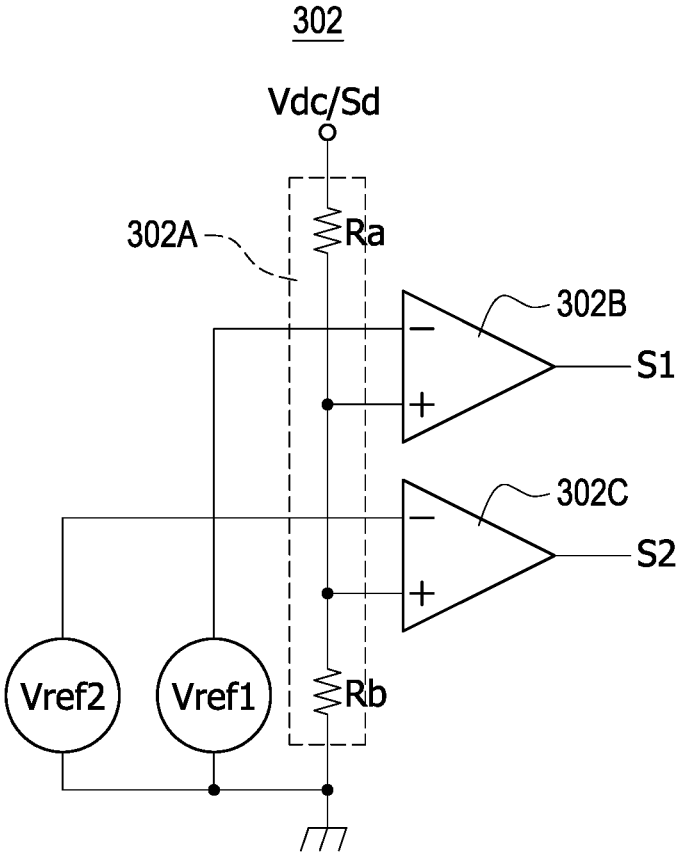
FIG. 3A is a circuit diagram of a detection circuit according to a first embodiment of the present disclosure.

Please refer to FIG. 3A, which shows a circuit diagram of a detection circuit according to a first embodiment of the present disclosure, and also refer to FIG. 1A to FIG. 2B. The detection circuit 302 includes a voltage division circuit 302A having voltage division resistors Ra,Rb, a first comparator 302B, and a second comparator 302C. The circuit connection manner is for illustrative purposes only, and is not intended to limit the present disclosure. As long as the detection circuit 302 that can provide the first detection signal S1 and the second detection signal S2 according to the change of the lighting drive signal Sd should be included in the scope of the present disclosure. A first end of the voltage division resistor Ra receives the DC working voltage Vdc or the lighting drive signal Sd, a second end of the voltage division resistor Ra is coupled to a first end of the voltage division resistor Rb, and a second end of the voltage division resistor Rb is coupled to the ground point. The first comparator 302B has a first input end (+), a second input end (−), and an output end O, and the second comparator 302C has a first input end (+), a second input end (−), and an output end O. The first input end (+) of the first comparator 302B and the first input end (+) of the second comparator 302C are coupled between the voltage division resistors Ra,Rb. The second input end (−) of the first comparator 302B is coupled to a first reference voltage Vref1 and the second input end (−) of the second comparator 302C is coupled to a second reference voltage Vref2. The DC working voltage or the lighting drive signal Sd is divided by the voltage division resistors Ra,Rb, and a voltage division value is generated at a node A between the voltage division resistor Ra and the voltage division resistor Rb. The first comparator 302B provides the first detection signal S1 at the output end O of the first comparator 302B according to the first reference voltage Vref1 and the voltage division value corresponding to the lighting drive signal Sd; the second comparator 302C provides the second detection signal S2 at the output end O of the second comparator 302C according to the second reference voltage Vref2 and the voltage division value corresponding to the lighting drive signal Sd. In particular, the voltage value of the first reference voltage Vref1 is greater than the voltage value of the second reference voltage Vref2.

When the voltage value of the lighting drive signal Sd is greater than the first reference voltage Vref1 and the second reference voltage Vref2, the first comparator 302B and the second comparator 302C output both in high level so that the driver circuit 304 operates in the working mode. When the voltage value of the lighting drive signal Sd is between the first reference voltage Vref1 and the second reference voltage Vref2, the first comparator 302B outputs in low level and the second comparator 302C outputs in high level. At this condition, the driver circuit 304 identifies the lighting drive signal Sd (signal identifications). After the identification of the lighting drive signal Sd is completed (i.e., the voltage value of the lighting drive signal Sd is between the first reference voltage Vref1 and the second reference voltage Vref2), the driver circuit 304 changes from the working mode to the sleep mode. When the voltage value of the lighting drive signal Sd is less than the first reference voltage Vref1 and the second reference voltage Vref2, the first comparator 302B and the second comparator 302C output both in low level so that the driver circuit 304 slows down the discharge speed of the lighting drive signal Sd. In particular, since the DC working voltage Vdc is a fixed voltage value, the first detection signal S1 compared by the first comparator 302B is also a fixed value. That is, only the lighting drive signal Sd with a pulse change causes the result compared by the first comparator 302B to change, and the second comparator 302C is the same.

Figure 3B:
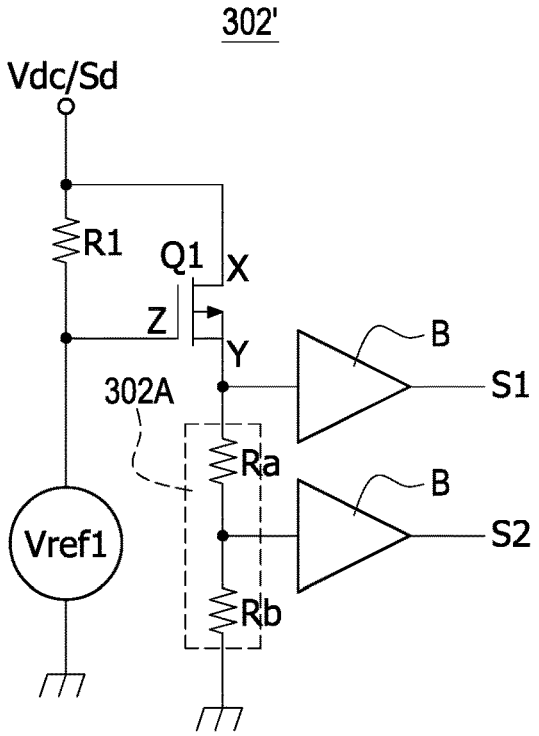
FIG. 3B is a circuit diagram of the detection circuit according to a second embodiment of the present disclosure.

Please refer to FIG. 3B, which shows a circuit diagram of the detection circuit according to a second embodiment of the present disclosure, and also refer to FIG. 1A to FIG. 3A. The difference between the detection circuit 302' shown in FIG. 3B and the detection circuit 302 shown in FIG. 3A is that the detection circuit 302' includes a first resistor R1, a first switch Q1, and a voltage division circuit 302A having voltage division resistors Ra,Rb. The circuit connection manner is for illustrative purposes only, and is not intended to limit the present disclosure. As long as the detection circuit 302 that can provide the first detection signal S1 and the second detection signal S2 according to the change of the lighting drive signal Sd should be included in the scope of the present disclosure. A first end of the first resistor R1 receives the DC working voltage Vdc or the lighting drive signal Sd, and a second end of the first resistor R1 receives a first reference voltage Vref1. The first switch Q1 has an input end X, an output end Y, and a control end Z. The input end X of the first switch Q1 receives the DC working voltage Vdc or the lighting drive signal Sd, and the control end Z of the first switch Q1 is coupled to the second end of the first resistor R1. A first end of the voltage division resistor Ra is coupled to the output end Y of the first switch Q1, a second end of the voltage division resistor Ra is coupled to a first end of the voltage division resistor Rb, and a second end of the voltage division resistor Rb is coupled to the ground point. A first detection signal S1 is provided at a node between the voltage division resistor Ra and the output end Y of the first switch Q1, and a second detection signal S2 is provided at a node between the voltage division resistors Ra,Rb.

When the voltage value of the lighting drive signal Sd is greater than the first reference voltage Vref1, the first switch Q1 is turned on, and the first detection signal S1 and the second detection signal S2 are both high level so that the driver circuit 304 operates in the working mode. When the voltage value of the lighting drive signal Sd is less than the first reference voltage Vref1, the first switch Q1 is turned on, and the first detection signal S1 is low level and the second detection signal S2 is high level. At this condition, the driver circuit 304 identifies the lighting drive signal Sd (signal identifications). After the identification of the lighting drive signal Sd is completed (i.e., the voltage value of the lighting drive signal Sd is between less than the first reference voltage Vref1 and turning off the first switch Q1), the driver circuit 304 changes from the working mode to the sleep mode. When the voltage value of the lighting drive signal Sd is too low, the first switch Q1 is turned off, and the first detection signal S1 and the second detection signal S2 are both low level so that the driver circuit 304 decreases the voltage of the lighting drive signal Sd. In particular, in the digital circuit, the analog-to-digital signal needs to use a buffer gate to increase the signal strength. Therefore, a buffer gate B can be added to the output path of the first detection signal S1 and the second detection signal S2 to improve the signal strength of the detection signal S1 and the second detection signal S2.

Figure 4:
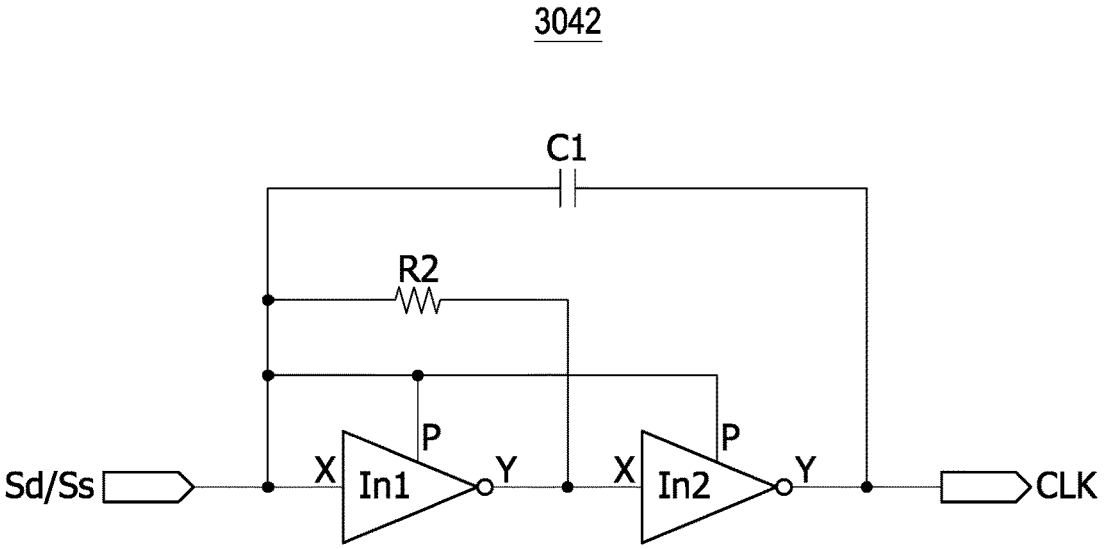
FIG. 4 is a circuit diagram of an oscillator according to the present disclosure.

Please refer to FIG. 4, which shows a circuit diagram of an oscillator according to the present disclosure, and also refer to FIG. 1A to FIG. 3B. The oscillator 3042 includes a first inverter In1, a second inverter In2, a second resistor R2, and a first capacitor C1. The circuit connection manner is for illustrative purposes only, and is not intended to limit the present disclosure. As long as the oscillator 3042 capable of generating the clock signal CLK should be included in the scope of the present disclosure. The first inverter In1 has an input end X, an output end Y, and a power end P. The input end X of the first inverter In) is coupled to a first end of the second resistor R2 and a first end of the first capacitor C1, the output end Y of the first inverter In1 is coupled to a second end of the second resistor R2, and the power end P of the first inverter In1 receives the lighting drive signal Sd and the sleep signal Ss. The second inverter In2 has an input end X, an output end Y, and a power end P. The input end X of the second inverter In2 is coupled to the first inverter In1 and the second end of the second resistor R2, the output end Y of the second inverter In2 is coupled to a second end of the first capacitor C1 and the control unit 304A, and the power end P of the second inverter In2 receives the lighting drive signal Sd and the sleep signal Ss. The first inverter In1 and the second inverter In2 are CMOS transistor circuit inverters. The design of different transistor sizes and the control of enabling and disabling are implemented to achieve the accurate control and low power consumption.

In the working mode, the sleep signal Ss makes the first inverter In1 and the second inverter In2 of the oscillator 3042 be enabled (as shown in FIG. 2B, before the time point t3 or after the time point t4). At this condition, the oscillator 3042 operates at a full-power condition to provide the clock signal CLK. When the voltage of the lighting drive signal Sd decreases below the second threshold value V2 (as shown in FIG. 2B, between the time point t3 and the time point t4), the sleep signal Ss provided by the logic circuit 304A-1 controls the first inverter In1 and the second inverter In2 to be disabled so that the oscillator 3042 is completely turned off to enter to the sleep mode. However, the connection relationship, the number, the size, and the signal control manner of the inverters are for illustrative purposes only and are not intended to limit the present disclosure.

Figure 5A:
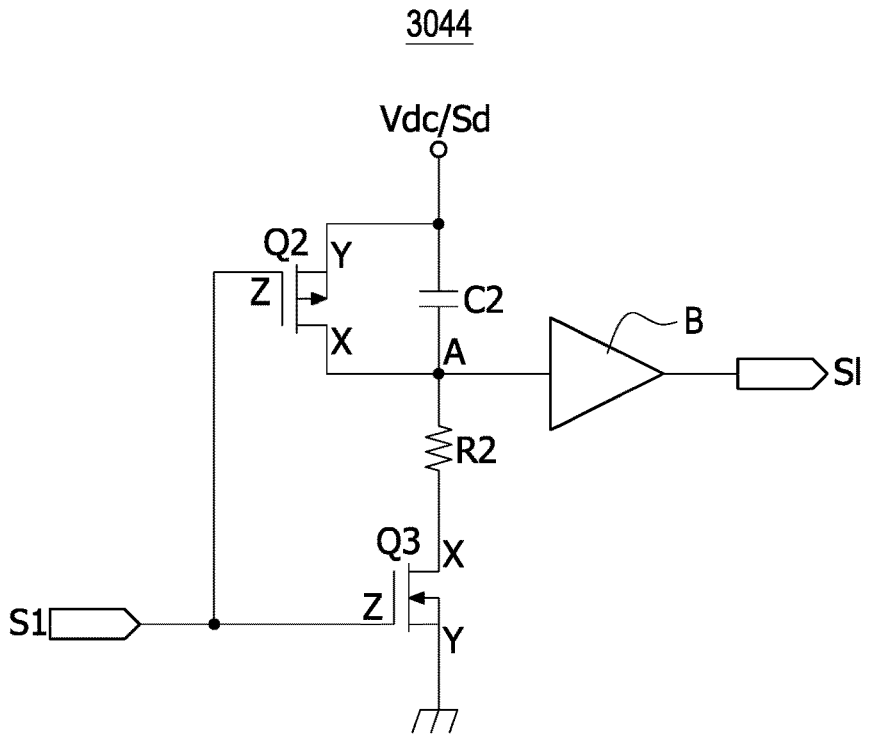
FIG. 5A is a circuit diagram of a latch circuit according to a first embodiment of the present disclosure.

Please refer to FIG. 5A, which shows a circuit diagram of a latch circuit according to a first embodiment of the present disclosure, and also refer to FIG. 1A to FIG. 4. The latch circuit 3044 includes a second switch Q2, a third switch Q3, a second capacitor C2, and a third resistor Q3. The circuit connection manner is for illustrative purposes only, and is not intended to limit the present disclosure. As long as the latch circuit 3044 that can provide the latch signal S1 according to the change of the first detection signal S1 should be included in the scope of the present disclosure. The second switch Q2 has an input end X, an output end Y, and a control end Z. The output end Y of the second switch Q2 is coupled to the power wire 10 and a first end of the second capacitor C2, and receives the DC working voltage Vdc or the lighting drive signal Sd through the power wire 10. The input end X of the second switch Q2 is coupled to a second end of the second capacitor, a first end of the third resistor R3, and the logic circuit 304A-1, and the control end Z of the second switch Q2 receives the first detection signal S1. The third switch Q3 incudes an input end X, an output end Y, and a control end Z. The input end X of the third switch Q3 is coupled to the second end of the second resistor R2, the output end Y of the third switch Q3 is coupled to the ground point, and the control end Z of the third switch Q3 receives the first detection signal S1.

The first detection signal S1 provided by the detection circuit 302 represents that the second switch Q2 is turned off and the third switch Q3 is turned on so that the second capacitor C2 stores energy when the lighting drive signal Sd is greater than the first threshold value V1 (before the time point t1 shown in FIG. 2B). When the voltage of the lighting drive signal Sd decreases from being greater than the first threshold value V1 to being less than the first threshold value V1, the second switch Q2 is turned on and the third switch Q3 is turned off so that the second capacitor C2 starts to discharge. When the time that the lighting drive signal Sd is less than the first threshold value V1 is greater than or equal to the holding time, the energy stored inside the second capacitor C2 has discharged below the predetermined energy value. At this condition, the latch signal S1 provided at a node between the second resistor R2 and the second capacitor C2 makes the logic circuit 304A-1 notify the register 304A-2 to store the identified lighting drive signal Sde as the lighting command Cl. In particular, a buffer gate B can also be installed on the output path of the latch signal S1, and its function is as described in FIG. 3B.

Figure 5B:
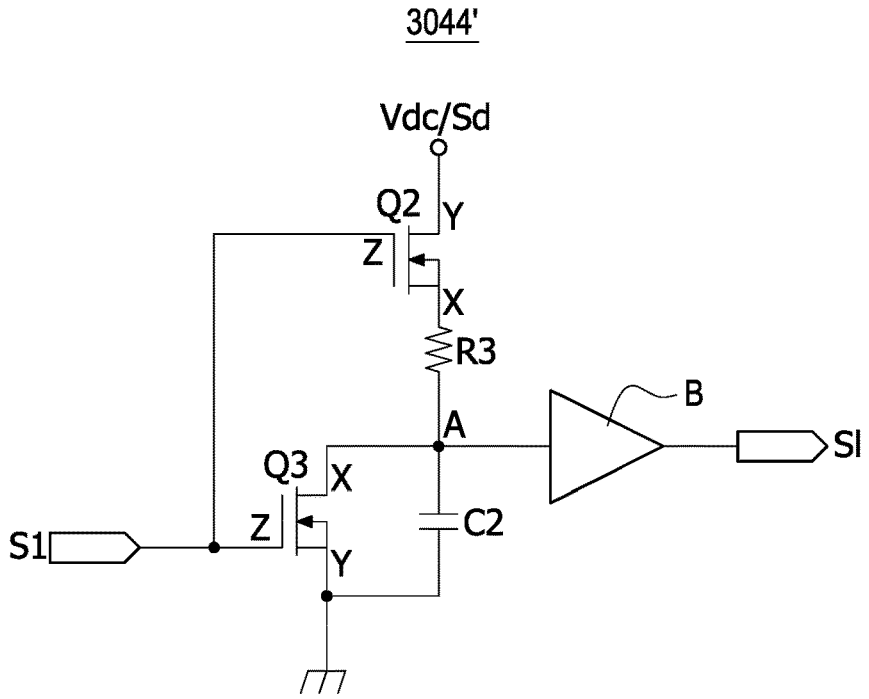
FIG. 5B is a circuit diagram of the latch circuit according to a second embodiment of the present disclosure.

Please refer to FIG. 5B, which shows a circuit diagram of the latch circuit according to a second embodiment of the present disclosure, and also refer to FIG. 1A to FIG. 5A. The difference between the latch circuit 3044' shown in FIG. 5B and the latch circuit 3044 shown in FIG. 5A is that the coupling positions and control manners of the second switch Q2, the third switch Q3, the second capacitor C2, and the third resistor R3. The circuit connection manner is for illustrative purposes only, and is not intended to limit the present disclosure. As long as the latch circuit 3044' that can provide the latch signal S1 according to the change of the first detection signal S1 should be included in the scope of the present disclosure. Specifically, the output end Y of the second switch Q2 is coupled to the power wire 10 and receives the DC working voltage Vdc or the lighting drive signal Sd through the power wire 10. The input end X of the second switch Q2 is coupled to a first end of the third resistor R3 and the control end Z of the second switch Q2 receives the first detection signal S1. The input end X of the third switch Q3 is coupled to a second end of the second resistor R2, a first end of the second capacitor C2, and the logic circuit 304A-1, the output end Y of the third switch Q3 is coupled to a second end of the second capacitor C2 and the ground point, and the control end Z of the third switch Q3 receives the first detection signal S1.

The first detection signal S1 provided by the detection circuit 302 represents that the second switch Q2 is turned on and the third switch Q3 is turned off so that the second capacitor C2 stores energy when the lighting drive signal Sd is greater than the first threshold value V1 (before the time point t1 shown in FIG. 2B). When the voltage of the lighting drive signal Sd decreases from being greater than the first threshold value V1 to being less than the first threshold value V1, the second switch Q2 is turned off and the third switch Q3 is turned on so that the second capacitor C2 starts to discharge. When the time that the lighting drive signal Sd is less than the first threshold value V1 is greater than or equal to the holding time, the energy stored inside the second capacitor C2 has discharged below a predetermined energy value. At this condition, the latch signal S1 provided at a node between the second resistor R2 and the second capacitor C2 makes the logic circuit 304A-1 notify the register 304A-2 to store the identified lighting drive signal Sde as the lighting command Cl. In particular, a buffer gate B can also be installed on the output path of the latch signal S1, and its function is as described in FIG. 3B.

Figure 5C:
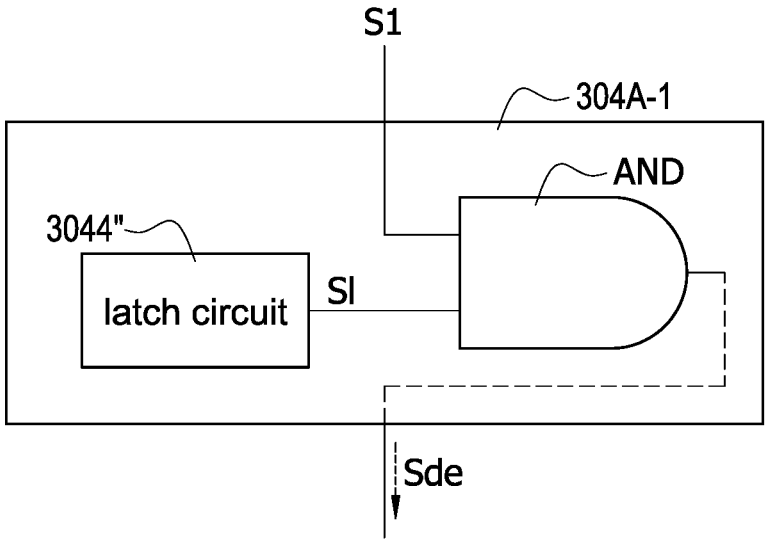
FIG. 5C is a circuit diagram of the latch circuit according to a third embodiment of the present disclosure.

Please refer to FIG. 5C, which shows a circuit diagram of the latch circuit according to a third embodiment of the present disclosure, and also refer to FIG. 1A to FIG. 5B. The difference between the latch circuit 3044" shown in FIG. 5C and the latch circuit 3044 shown in FIG. 5A is that the latch circuit 3044" is composed of logic gates, such as AND gates, OR gates, NOT gates, and so on, and the latch circuit 3044" may be integrated in the logic circuit 304A-1. When the time that the lighting drive signal Sd is less than the first threshold value V1 is greater than or equal to the holding time, the latch signal S1 provided by the logic gates of the latch circuit 3044" causes the output of the AND gate in the logic circuit 304A-1 to change. The logic circuit 304A-1 notifies the register 304A-2 to store the identified lighting drive signal Sde as the lighting command Cl according to the output change of the AND gate. In particular, the output of the AND gate may be determined by additional logic gates (not shown, such as but not limited to, protection logic circuits, etc.) before the identified lighting drive signal Sde can be outputted, and therefore the output of the AND gate to the identified lighting drive signal Sde is indicated by a dotted line.

Figure 6:
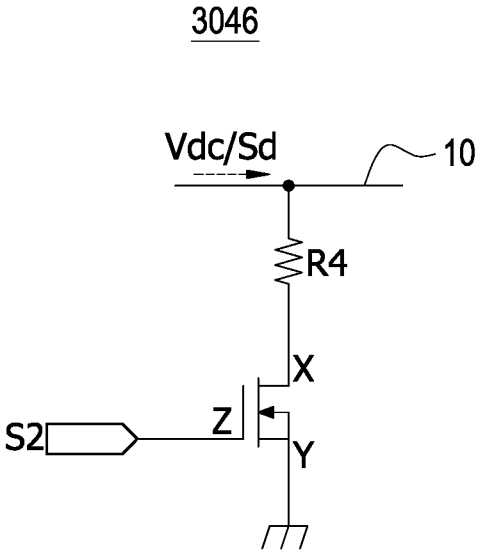
FIG. 6 is a circuit diagram of a discharge circuit according to the present disclosure.

Please refer to FIG. 6, which shows a circuit diagram of a discharge circuit according to the present disclosure, and also refer to FIG. 1A to FIG. 5C. The discharge circuit 3046 includes a discharge switch Q4. The discharge switch Q4 has an input end X, an output end Y, and a control end Z. The input end X of the discharge switch Q4 is coupled to the power wire 10, the output end Y of the discharge switch Q4 is coupled to the ground point, and the control end Z of the discharge switch Q4 receives the second detection signal S2. The circuit connection manner is for illustrative purposes only, and is not intended to limit the present disclosure. As long as the discharge speed of the lighting drive signal Sd can be adjusted according to the change of the second detection signal S2, it should be included in the scope of the present disclosure. When the lighting drive signal Sd is greater than the second threshold value V2, the second detection signal S2 controls turning on the discharge switch Q4 so that the lighting drive signal Sd generates a current path to the ground and quickly discharges. When the lighting drive signal Sd is less than the second threshold value V2, the second detection signal S2 controls turning off the discharge switch Q4 so that the lighting drive signal Sd is floating to slow down the discharge speed of the lighting drive signal Sd. In particular, in order to avoid excessive current flowing through the discharge switch Q4 to the ground point when the discharge switch Q4 is turned on, a fourth resistor R4 can be installed on the current path from the lighting drive signal Sd to the ground point to limit the current amplitude of this current path.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. An LED module with sleep mode, comprising:

a detection circuit configured to receive a lighting drive signal through a power wire, a driver circuit coupled to the detection circuit and configured to receive the lighting drive signal, the driver circuit comprising:

a control unit coupled to the detection circuit, and at least one LED coupled to the control unit, wherein the control unit receives a lighting command according to the lighting drive signal and controls lighting behaviors of the at least one LED according to the lighting command; when the driver circuit detects the voltage of the lighting drive signal decreases below a first threshold value, the driver circuit performs signal identifications of the lighting drive signal, and when the signal identifications of the lighting drive signal are completed, the driver circuit changes from a working mode to a sleep mode; when the voltage of the lighting drive signal decreases below a second threshold value, the driver circuit slows down the discharge speed of the lighting drive signal.

2. The LED module with sleep mode in claim 1, wherein when the driver circuit detects that the lighting drive signal rises to be greater than or equal to the second threshold value according to a second detection signal, the driver circuit changes from the sleep mode back to the working mode.

3. The LED module with sleep mode in claim 1, wherein the detection circuit comprises:

a voltage division circuit configured to receive the lighting drive signal, a first comparator coupled to the voltage division circuit and configured to receive a first reference voltage, and a second comparator coupled to the voltage division circuit and configured to receive a second reference voltage, wherein the first comparator provides a first detection signal according to the first reference voltage and a voltage division value corresponding to the lighting drive signal, and the second comparator provides the second detection signal according to the second reference voltage and the voltage division value corresponding to the lighting drive signal.

4. The LED module with sleep mode in claim 1, wherein the detection circuit comprises:

a first resistor having a first end and a second end; the first end receiving the lighting drive signal and the second end receiving a first reference voltage, a first switch having an input end, an output end, and a control end; the input end receiving the lighting drive signal and the control end coupled to the second end of the first resistor, and a voltage division circuit coupled to the output end of the first switch and the control unit, wherein the voltage division circuit divides a voltage at the output end of the first switch and provides a first detection signal and a second detection signal.

5. The LED module with sleep mode in claim 1, wherein the driver circuit further comprises:

an oscillator coupled to the control unit and configured to receive the lighting drive signal, wherein in the working mode, the oscillator is configured to provide a clock signal to the control unit according to the lighting drive signal; in the sleep mode, a sleep signal provided by the control unit is configured to turn off the oscillator and an analog circuit so that the oscillator does not provide the clock signal to the control unit and the analog circuit is turned off.

6. The LED module with sleep mode in claim 5, wherein the oscillator comprises:

a first inverter having an input end, an output end, and a power end; the input end coupled to a first end of a second resistor and a first end of a first capacitor, the output end coupled to a second end of the second resistor, and the power end receiving the lighting drive signal and the sleep signal, and a second inverter having an input end, an output end, and a power end; the input end coupled to the first inverter and the second end of the second resistor, the output end coupled to a second end of the first capacitor and the control unit, and the power end receiving the lighting drive signal and the sleep signal.

7. The LED module with sleep mode in claim 1, wherein the driver circuit comprises:

a latch circuit configured to receive the lighting drive signal and a first detection signal, and determines whether to provide a latch signal according to the first detection signal corresponding to the lighting drive signal, wherein when the time that the lighting drive signal is less than the first threshold value is greater than or equal to a holding time, the control unit stores the identified lighting drive signal as the lighting command.

8. The LED module with sleep mode in claim 7, wherein the control unit comprises:

a logic circuit coupled to the detection circuit, and a register coupled to the logic circuit, wherein the latch circuit is composed of logic gates, the logic gates are used to provide the latch signal and the logic gates are integrated in the logic circuit when the time is greater than or equal to the holding time, the latch signal makes the logic circuit notify the register to store the identified lighting drive signal as the lighting command.

9. The LED module with sleep mode in claim 7, wherein the latch circuit comprises:

a second switch having an input end, an output end, and a control end; the output end coupled to the power wire and a first end of a second capacitor, the input end coupled to a second end of the second capacitor, a first end of a third resistor, and the control unit, and the control end receiving the first detection signal, and a third switch having an input end, an output end, and a control end; the input end coupled to a second end of a second resistor, the output end coupled to a ground point, and the control end receiving the first detection signal.

10. The LED module with sleep mode in claim 7, wherein the latch circuit comprises:

a second switch having an input end, an output end, and a control end; the output end coupled to the power wire, the input end coupled to a first end of a third resistor, and the control end receiving the first detection signal, and a third switch having an input end, an output end, and a control end; the input end coupled to a second end of a second resistor, a first end of a second capacitor, and the control unit, the output end coupled to a second end of the second capacitor and a ground point, and the control end receiving the first detection signal.

11. The LED module with sleep mode in claim 1, wherein the driver circuit comprises:

a discharge circuit coupled to the power wire and configured to receive a second detection signal, wherein when the discharge circuit realizes that the lighting drive signal is less than the second threshold value through the second detection signal, the discharge circuit slows down the discharge speed of the lighting drive signal.

12. The LED module with sleep mode in claim 11, wherein the discharge circuit comprises:

a discharge switch having an input end, an output end, and a control end; the input end coupled to the power wire, the output end coupled to a ground point, and the control end receiving the second detection signal.

13. An LED light string with sleep mode comprising:

a power wire configured to receive a DC working voltage, a control module coupled to the power wire, and the control module comprising:

a power switch coupled to the power wire, and a controller coupled to the power switch, and at least one LED module, each of the at least one LED module being an LED module with sleep mode as claimed in claim 1; the at least one LED module coupled to the control module through the power wire, and configured to receive the lighting drive signal and the DC working voltage transmitted by the control module through the power wire;

wherein when the controller controls turning on the power switch, the DC working voltage provides a power-supplying path for supplying power to the at least one LED module through the power wire; when the controller generates the lighting drive signal of one LED module of the at least one LED module, the controller continuously switches turning on and turning off the power switch according to the lighting command so that the DC working voltage on the power wire provides the lighting drive signal composed of a plurality of pulses, and the lighting drive signal is transmitted to the LED module through the power wire.

* * * * *